US006446564B1

(12) United States Patent
Anderson

(10) Patent No.: US 6,446,564 B1
(45) Date of Patent: Sep. 10, 2002

(54) DESK WITH SLIDING TOP SECTION AND KEYBOARD TRAY

(76) Inventor: Peter Charles Anderson, 253 Center District Rd., Sugar Hill, NH (US) 03585

( * ) Notice: Subject to any disclaimer, the term of this patent is extended or adjusted under 35 U.S.C. 154(b) by 191 days.

(21) Appl. No.: 09/692,484

(22) Filed: Oct. 19, 2000

Related U.S. Application Data

(60) Provisional application No. 60/171,123, filed on Dec. 16, 1999, and provisional application No. 60/221,743, filed on Jul. 31, 2000.

(51) Int. Cl.[7] ..... A47B 1/04
(52) U.S. Cl. ..... 108/71; 312/194
(58) Field of Search ..... 312/194, 223.3, 312/322, 208.1, 313, 241; 108/69, 71, 76, 65, 70, 72, 73, 74

(56) References Cited

U.S. PATENT DOCUMENTS

| | | | | | |
|---|---|---|---|---|---|
| 897,262 | A | * | 8/1908 | Weifelspuetz | 108/73 |
| 1,069,645 | A | * | 8/1913 | Pasmore | 108/71 |
| 1,460,754 | A | * | 7/1923 | Hlozek | 108/74 |
| 2,295,095 | A | * | 9/1942 | Teague, Jr. | 108/76 |
| 3,794,398 | A | * | 2/1974 | Lindsay | 312/241 |
| 4,145,097 | A | | 3/1979 | Naess et al. | |
| 4,709,972 | A | | 12/1987 | LaBudde et al. | |
| 4,766,422 | A | | 8/1988 | Wolters et al. | |
| 4,828,342 | A | * | 5/1989 | Stefan | 108/86 |
| 4,991,518 | A | | 2/1991 | Romero, Jr. | |
| 5,626,323 | A | | 5/1997 | Lechman et al. | |
| 5,957,059 | A | | 9/1999 | Burhman | |

FOREIGN PATENT DOCUMENTS

| | | | | |
|---|---|---|---|---|
| DE | 62487 | * | 3/1892 | 108/71 |

* cited by examiner

*Primary Examiner*—Lanna Mai
*Assistant Examiner*—Jerry A. Anderson
(74) *Attorney, Agent, or Firm*—Vernon C. Maine; Scott J. Asmus; Maine & Asmus

(57) ABSTRACT

A dual use desk for use with a monitor and keyboard, the desk having a retracting lid section conforming to a lid opening in the front edge of the desktop, the lid retraction mechanism consisting of the lid being hingedly attached to commonly available linear drawer sliders mounted at a rearward sloping angle below the desktop. The lid is retracted with a simple front edge tilt up, and slide back motion, to expose a lower level keyboard tray. The keyboard tray may be extendible outward as well, and may have an accessory tray attached, which is exposed for access when the lid is retracted and the keyboard extended. Alternative configurations permit a monitor to be located below desktop level, visible when the lid is retracted and the keyboard extended.

20 Claims, 10 Drawing Sheets

DESK WITH SLIDING TOP SECTION AND KEYBOARD TRAY

This application relates and claims priority to applications No. 60/171123, file date Dec. 16, 1999, and U.S. No. 60/221743, file date Jul. 31, 2000.

FIELD OF INVENTION

The invention relates to desks and work stations that are convertible between a conventional working surface and configurations suitable for using a keyboard. In particular, the invention relates to designs and mechanisms suitable for integrating and operating a removable desktop section for access to a keyboard.

BACKGROUND OF THE INVENTION

The conventional office desk pre-dates the personal computer by more than a few years. The prime real estate or region of the desktop that is most important is that directly in front of the seated user, immediately accessible with hands and eyes without a stretch or a head movement, such as when reading, writing, or typing.

When personal computers first appeared on the scene, users simply placed them on their existing desks; the monitor on the back edge of the desk, the keyboard in front of the monitor. Many new computer users still try this first. However, it soon becomes evident that a conventional desk has serious disadvantages in a dual use in that the usual placement of the keyboard precludes the primary or alternative use of the desktop as a writing or working surface. Further, the keyboard, setting on the desktop is generally not at a comfortable height for typing.

Many attempts have been made to overcome these basic problems. Most of these designs can be loosely categorized into two general forms; dedicated computer desks, and dual purpose desks. An example of a dedicated computer desk design is a desk with an open section in the front edge of the desktop into which a keyboard shelf has been attached, typically a few inches below the level of the desktop. This design puts the keyboard at a comfortable height but does not provide a writing surface.

An example of a dual use desk is one modified to provide a pull-out tray from under the desktop for a keyboard, which can be stowed below the desktop level when not in use. This leaves the desktop free for other purposes, but requires the user to push back his chair and sit at an inconvenient distance from the desk and computer monitor. Another example provides an opening in the desktop which allows the keyboard to be located on a shelf below the desktop, and which can be covered by a hinged lid when the keyboard is not in use. The lid occupies space elsewhere on the desktop when hinged away from the opening, and may even obscure the viewing screen of the computer monitor.

Other examples of dual use desks provide openings in the desktop covered by lids which can be lowered and pushed along multiple branched tracks below the desktop. These require the manufacture of complex, multiple and/or branched tracks specifically designed to allow the lid to be moved from the lower to the higher track, for example. They may also require springs to raise the lids and special pins to engage the tracks. There are also designs with openings in the desktop covered by lids which can be lowered or raised by geared mechanisms. These also are an expensive and cumbersome solution.

There are many desk designs which provide facilities for housing computer equipment, including monitors, below the level of the desktop. These keep the desktop generally free for other uses and may allow viewing of a screen at a low angle.

The patents listed below may provide further useful context for appreciating the material that follows:

Lechman's U.S. Pat. No. 5,626,323, issued May 6, 1997, and U.S. Pat. No. 5,662,395, issued Sep. 2, 1997, disclose an adjustable keyboard holder for a computer desk. It uses a sliding rail system with special, independently hinged link and roller assemblies, connecting the keyboard holder to the rails, so that the keyboard slid to an extended position in front of the desktop and be manipulated into a range of sloping attitudes and then locked into that position.

Wolters et al's U.S. Pat. No. 4,766,422, issued Aug. 23, 1988, describes a computer integrated desk where the desktop pad is linked to a custom keyboard mechanism such that pushing back on the desktop pad, which normally covers an opening in the desktop, brings a concealed keyboard from a stowed position under the desk into an extended position at the front edge of the desktop. The mechanism is complex and unique.

Stefan's U.S. Pat. No. 4,828,342, issued May 9, 1989, discloses a split desktop with over and under sliding capability that permits equipment to be elevated from beneath the desk to desktop level, and permits the exposure or covering of a recessed keyboard at the front edge of the desk. The sliding mechanism consists of a custom design, split level channel system in which several support pins attached to the two desk top sections travel. Over travel of the front section to a front edge outboard position provides clearance to permit the rear section to be slid from desktop level to a lower level and vice versa. The keyboard holder is illustrated as stationary.

Naess et al's U.S. Pat. No. 4,145,097, issued Mar. 20, 1979, discloses a computer desk with a slidable keyboard holder and a stowable front section providing access to a keyboard on the keyboard holder when it is extended. The custom mechanism for stowing the removable piece of the desk top is clearly disclosed. It utilizes front and back edge pins on each side of the removable piece, and a left and right side pin channel mechanism in which the pins are engaged. Each channel has a common lower level horizontal sliding section by which the removable section can be stowed underneath the back portion of the desktop, and separate front and rear C sections of channel, the dimensions of provide for lifting and setting the removable piece by its pins at a desktop level at the front of the desk. The keyboard holder is similarly configured with pins, but has a horizontal channel track with a Y component that permits the front edge of the keyboard holder to be elevated with respect to the back edge, providing more knee clearance under the desktop when the keyboard is stowed.

In summary, prime desktop space and all usable space within arms reach of the seated user being at a premium, the general problem lies in finding ways to increase the utility and efficiency of the space available in a person's desk. Computers and keyboards now being essential to many user's daily activities, the desk must function as a computer work station, and in combination or alternatively as a conventional desktop for other activities. As is demonstrated by the prior art, the problem has been addressed many times in many ways.

However, a review of the prior art makes it clear that there is a requirement for a simpler design for a dual purpose or convertible desktop feature; a design that is easily and quickly switchable by the user, between one or more desktop configurations permitting access to a keyboard for keyboard operations, and one providing maximum desktop space for other activities. What is needed is a design for a convertible desktop feature that incorporates an inexpensive and commonly available transport mechanism; a design that is easily implemented in desks of various architectures and construction; and a design that is also suitable for kit desk designs intended for user assembly. It is this need to which the instant invention is directed.

SUMMARY OF THE INVENTION

The present invention is basically a dual use desk with a sliding desktop section and retraction system which provides a free area of desktop when in the raised position and access to a keyboard or accessory tray when in the retracted position. The lid slides below the desktop at a shallow angle. This characteristic is achieved by the use of conventional drawer slides in combination with a simple hinge or hinges providing a lateral hinge line between the top end of the slider and the desktop section. Drawer slides and hinges suitable for use with the design are readily available "off the shelf" from virtually thousands of manufacturers and outlets. The design is easy and light in use and provides a very quick, convenient and inexpensive means of changing from keyboard access to working surface from moment to moment. It allows the user to sit close to the desk and viewing screen and does not require him to change his position to use a writing surface.

The sliding lid system may be used in conjunction with a conventional pull-out keyboard tray. The sliding lid moves independently of the keyboard. The combination of retracted lid and pulled-out keyboard tray creates a visible open space behind the pulled-out tray which provides for the normally unused space below the desktop to be used for a number of purposes including shelves, CPU, or an electronic display unit or viewing screen arranged with its viewing angle visible between the stowed lid and the extended keyboard tray.

Alternately, a drawer may be installed behind the keyboard tray and coupled to the tray so that it moves with it. Because the sliding lid provides an opening in the desktop the drawer is accessible when it is pulled forward by the tray.

The sliding lid system does not obscure or interfere with anything on the desktop. It does not require any specially-made components and it is suitable for incorporation into any common desk configuration or design, including kit designs which are assembled by the retail purchaser at the point of use.

DESCRIPTION OF THE PREFERRED EMBODIMENT

The invention is susceptible of many embodiments. What follows is a description of preferred embodiments, illustrative but not limiting of the scope of the invention.

Figure 1:
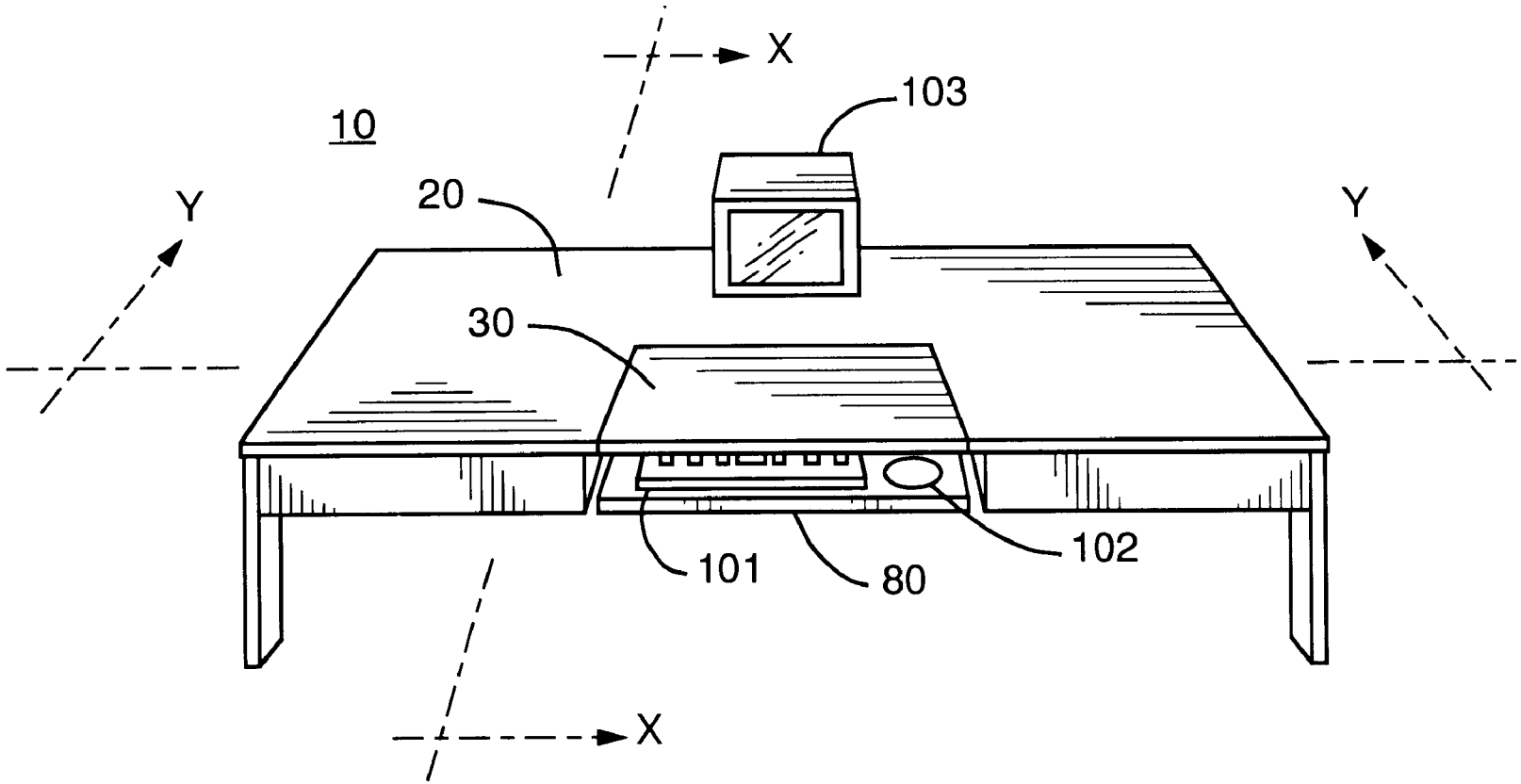
FIG. 1 is an upper front perspective view of a desk with a sliding lid feature, the lid in the raised position covering a keyboard tray.
Figure 2:
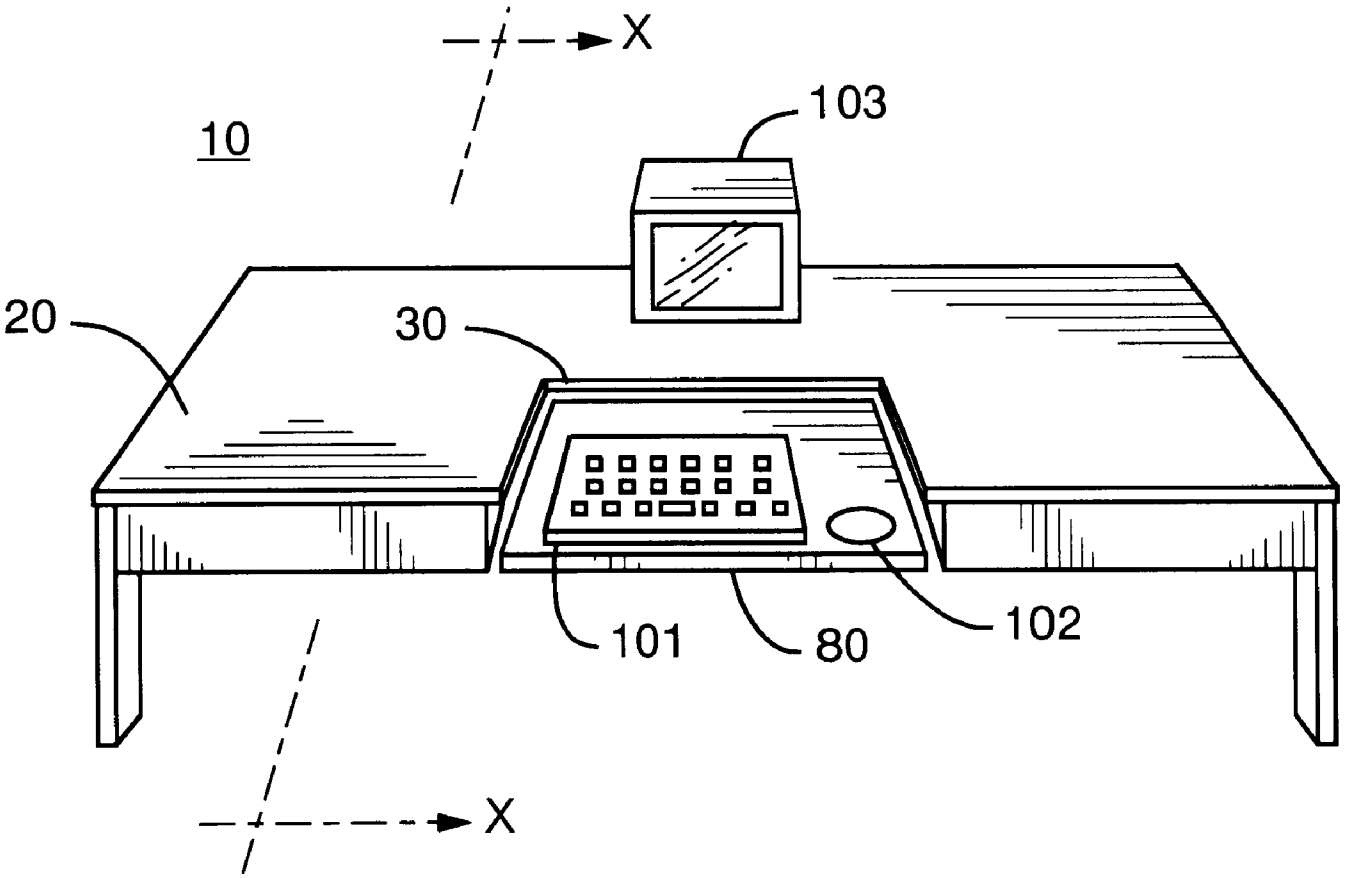
FIG. 2 is an upper front perspective view of the desk of FIG. 1, with the sliding lid retracted below the desktop, exposing the keyboard tray.

Referring to FIGS. 1 and 2, desk 10 includes a desktop 20 that can be conveniently be filled with a retractable desktop section referred to here as retractable lid 30, as in FIG. 1. Keyboard shelf 80 is recessed below the level of desktop 20 such that retractable lid 30, when extended to a raised position as in FIG. 1, covers it. Keyboard 101, mouse 102, and computer monitor 103, not a part of the invention, are present on keyboard shelf 80 and desktop 20 to illustrate the general purpose to which the invention is directed.

Figure 3:
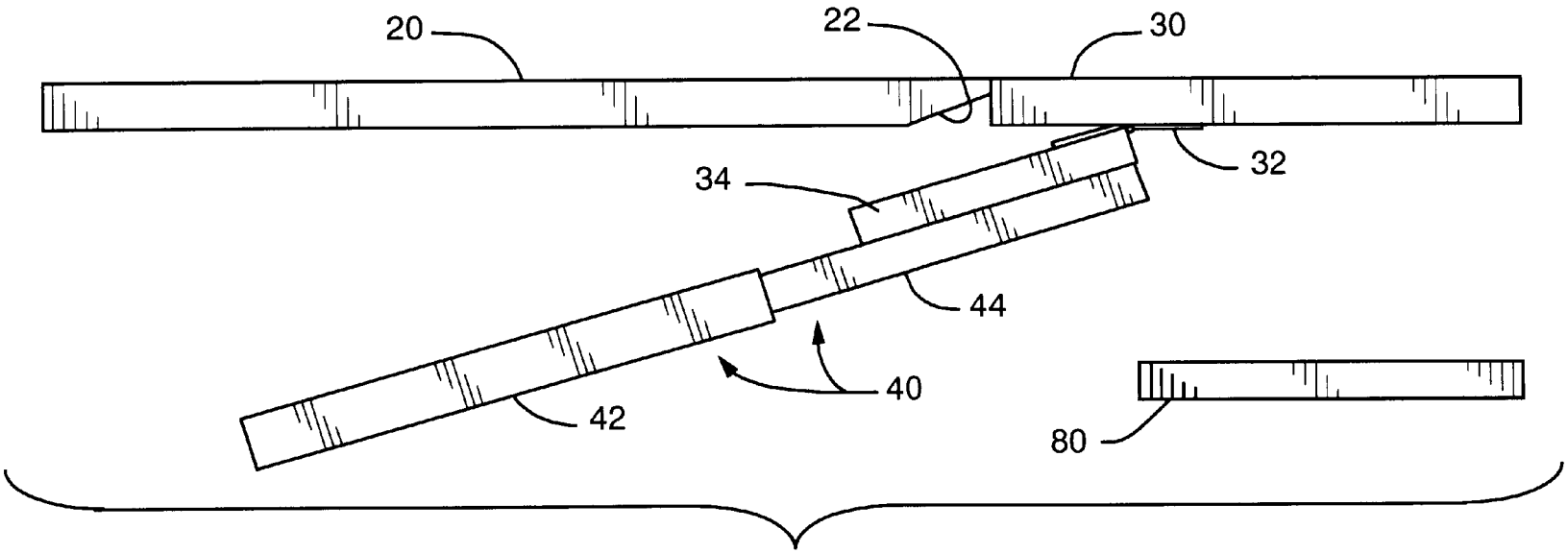
FIG. 3 is a partial cross section view at XX of FIG. 1, illustrating the orientation of the desktop, sliding lid in the raised position covering a stationary keyboard shelf, the lid attached by hinges to a cross member, the cross member attached to respective left and right side drawer sliders which are in turn attached to the sides of the knee space opening in the desk.
Figure 4:
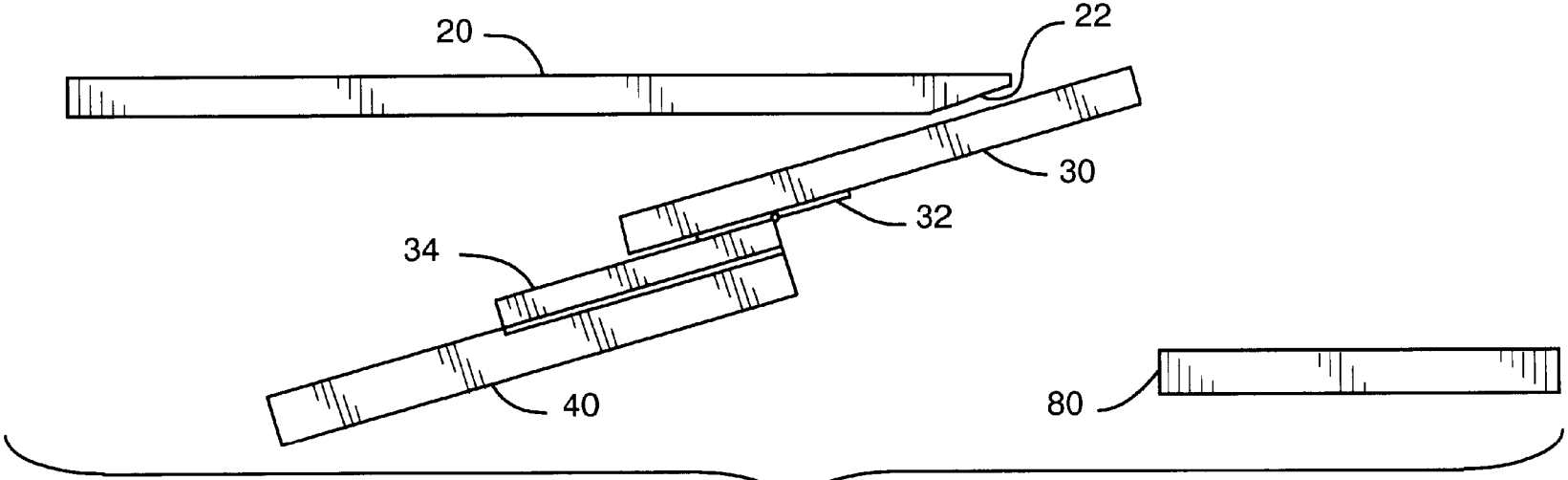
FIG. 4 is a partial cross section view at XX of FIG. 2, illustrating the orientation of the desktop, sliding lid in the retracted position exposing the stationary keyboard shelf.

Referring to FIGS. 3 and 4, a sectional view through XX of FIGS. 1 and 2, there is shown one embodiment of the retractable lid mechanism of the invention. Retractable lid 30 is secured by hinges 32 to a slave board, here called cross member 34, which is in turn attached to the sliding member 44 of a pair of full-extension linear drawer slides 40. The base member 42 of each drawer slide 40 is attached to or supported by desk structure at a shallow angle to the horizontal, preferrably from the desk top brackets or knee space sidewalls, whichever is convenient to the desk configuration.

Figure 6:
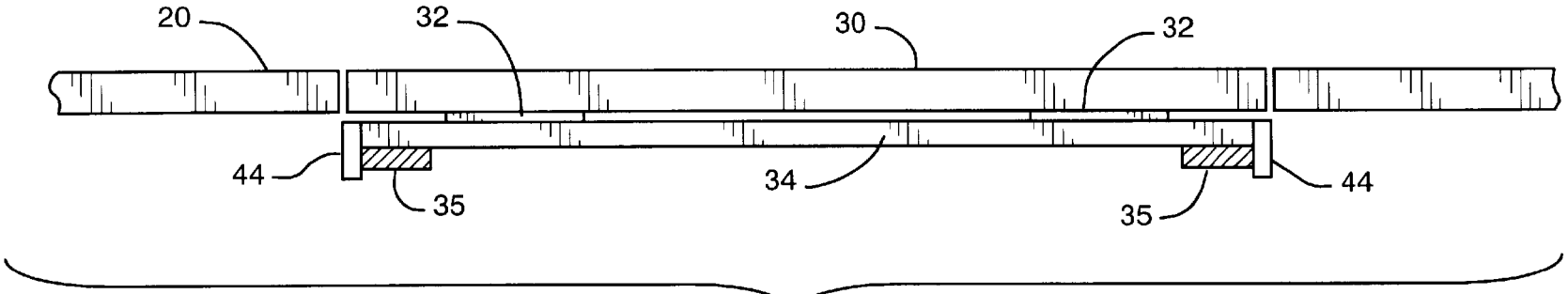
FIG. 6 is a partial front elevation at YY of FIG. 1, illustrating the front edge of the sliding lid in the raised position, attached by hinges to a cross member, the cross member attached to the upper end of respective left and right side drawer sliders.

The edges or ends of wooden cross member 34 may need to be thicker than is required overall, to provide center section clearance between fixed and sliding members, and to provide sufficient width of material to match the width and screw hole locations of typical drawer slides 40. FIG. 6, a section through YY of FIG. 1, illustrates a supplemental member 35 glued to each end of cross member 34, providing the necessary thickness for wood screws applied through sliding member 44. Cross member 34 may be fabricated of other than wood, of course, as may other components of the desk.

Other embodiments may omit cross member 34, relying on the rigidity of lid 30 and good hinge attachment features connecting the lid directly to the sliding component of the slider assemblies in order to maintain proper alignment of the left and right side sliders for smooth extension and retraction. Still other embodiments may incorporate means for limited lateral adjustment as between the slides and the lid, at any of the junctures of the component parts linking the sliders to the lid. Lateral adjustment can be useful for aligning the lid with more precision to the desktop opening.

Figure 7:
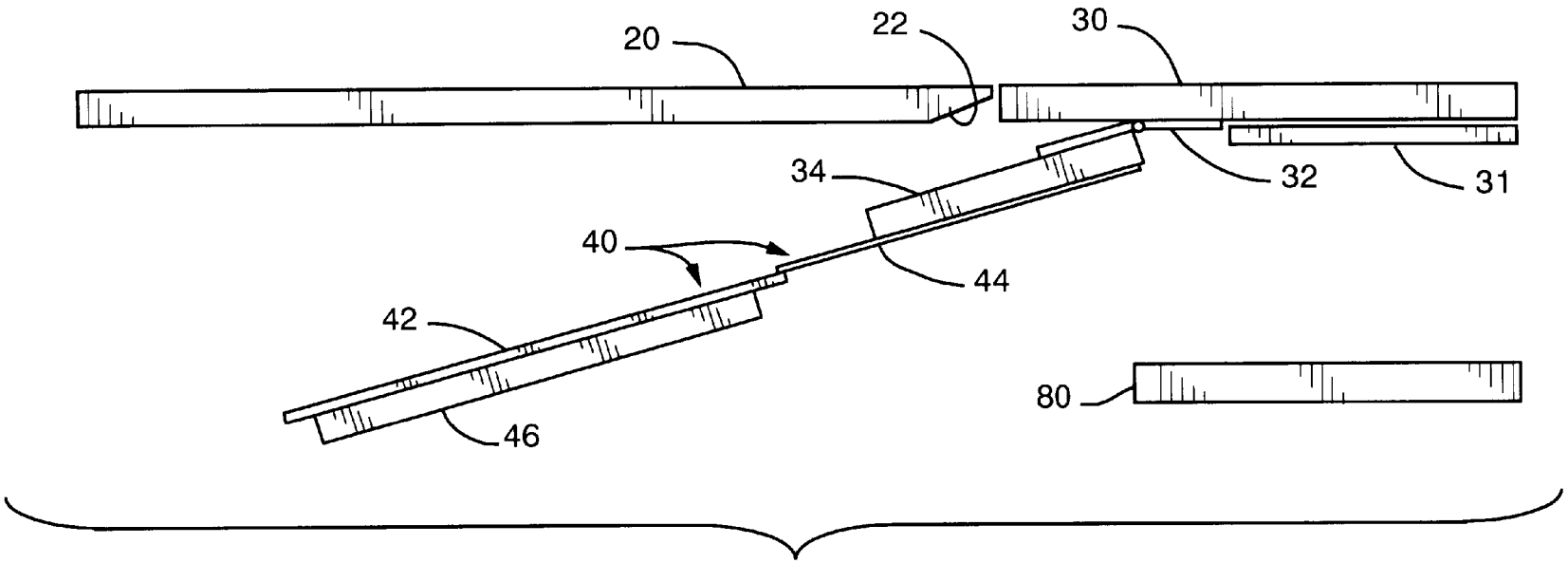
FIG. 7 is a partial cross section view of a variation of the embodiment of FIGS. 3 and 4, illustrating the orientation of the desktop, sliding lid in the raised position covering a stationary keyboard shelf, the lid attached by hinges to a cross member, the cross member attached to respective left and right side, bottom-mounting drawer sliders which are in turn attached to another cross member attached to the sides of the knee space opening in the desk.

Referring to FIG. 7, an alternative to the FIGS. 3 and 4 section through XX of FIG. 1, draw slides 40 may alternatively be oriented flatwise with respect to cross member 34 and likewise to a support board 46, in what would be described as a bottom mounting mode if the cross member were a drawer. In this mounting mode, base members 42 of drawer slides 40 are fixed to the angled support board 46 below them or to an alternative support system such as brackets which might be attached to the underside of desktop 20 or elsewhere to desk structure.

In use, when lid 30 is extended to a raised position over keyboard shelf 80, as shown in FIG. 3, lid 30 rests on left and right side supports 31, as in FIG. 7, affixed to desktop 20 on each side of the lid opening. The supports must be configured to permit clearance for extending and retracting lid 30, while providing adequate weight bearing capacity for loads imposed on the section by a user. When the user requires access to keyboard shelf 80, the user pulls lid 30 towards him slightly, to provide a small amount of clearance between lid 30 and the back edge of the lid opening, then lifts the front edge of lid 30 until it is parallel to drawer slides 40, and then allows it to slide downward and backwards into a retracted or stowed position beneath desktop 20.

The attach point of hinges 32 to the underside of lid 30, is sufficiently forward of the back edge of lid 30, so that the back edge of lid 30 is rotated below and clear of the opening in desktop 20 when lid 30 is rotated parallel to the slides. The back edge of the lid opening in desktop 20 may have a chamfered edge 22, to facilitate lid clearance. Lid 30 follows cross member 34 downwards and backwards on drawer slides 40, assisted by gravity. At the retracted end of the slide travel, the front edge of lid 30 is near the back edge of the lid opening and level with or below the top level of desktop 20, as shown in FIG. 4. At this position, lid 30 rests on stowed position lid supports, omitted here for clarity, or on the chamfered back end of the extended lid position side supports.

When lid 30 is required by the user to be raised over keyboard shelf 80 for use as a writing or work surface, the user pulls lid 30 forward. Lid 30 and cross member 34 move smoothly until drawer slides 40 reach full extension. Lid 30 then pivots downward on hinges 32 to rest on the side supports, flush or slightly above flush with desktop 20, as explained below.

The system is preferably configured so that when lid 30 is pulled fully forward to its upper stop and held there while being rotated to the horizontal, it is slightly above the top surface of the desk. Upon release of lid 30, gravity then pulls the lid retraction assemblage downward, and hence lid 30 slightly back and down until it butts against the back edge of the lid opening and is flush with desktop 20. The weight of the lid retraction assemblage holds lid 30 firmly in this position. This is essentially a self positioning feature of the invention that is both simple to implement and effective in its result.

If desk top 20 is of very thick material, the back edge of the lid opening may be configured with a chamfered surface 22 as shown in the figures, to facilitate lid clearance. With materials up to at least three quarters of an inch thick, the pivot point of hinges 32 on lid 30 may be positioned so that lid 30 tilts and clears desktop 20 without any chamfer. When the choice of pivot point results in too little support at the back edge of lid 20, then a support such as a rail or protruding nubs may be added along the back edge of the lid opening. Alternatively, extended lid 30 may be prevented from tipping down at the back under working pressure, by a fixture at the front edge ends of lid 30 which engages with the desktop when lid 30 is extended, and disengages for retraction.

Ball-bearing drawer slides 40 give lid 30 a smooth and free movement. The system can utilize cheaper alternatives such as the wood or plastic groove type drawer slide assemblies which are sometimes used as drawer guides, but ball-bearing slides are preferred.

The dimensions and positioning of the sliding system components must be arranged to suit the thickness of the desktop and the angle at which the slides are mounted. In the preferred embodiments of the figures, drawer slides 40 are shown mounted at approximately 15 degrees to the horizontal. Other angles between five and 45 degrees may be suitable, depending on the overall geometry and weight of the elements.

Figure 10:
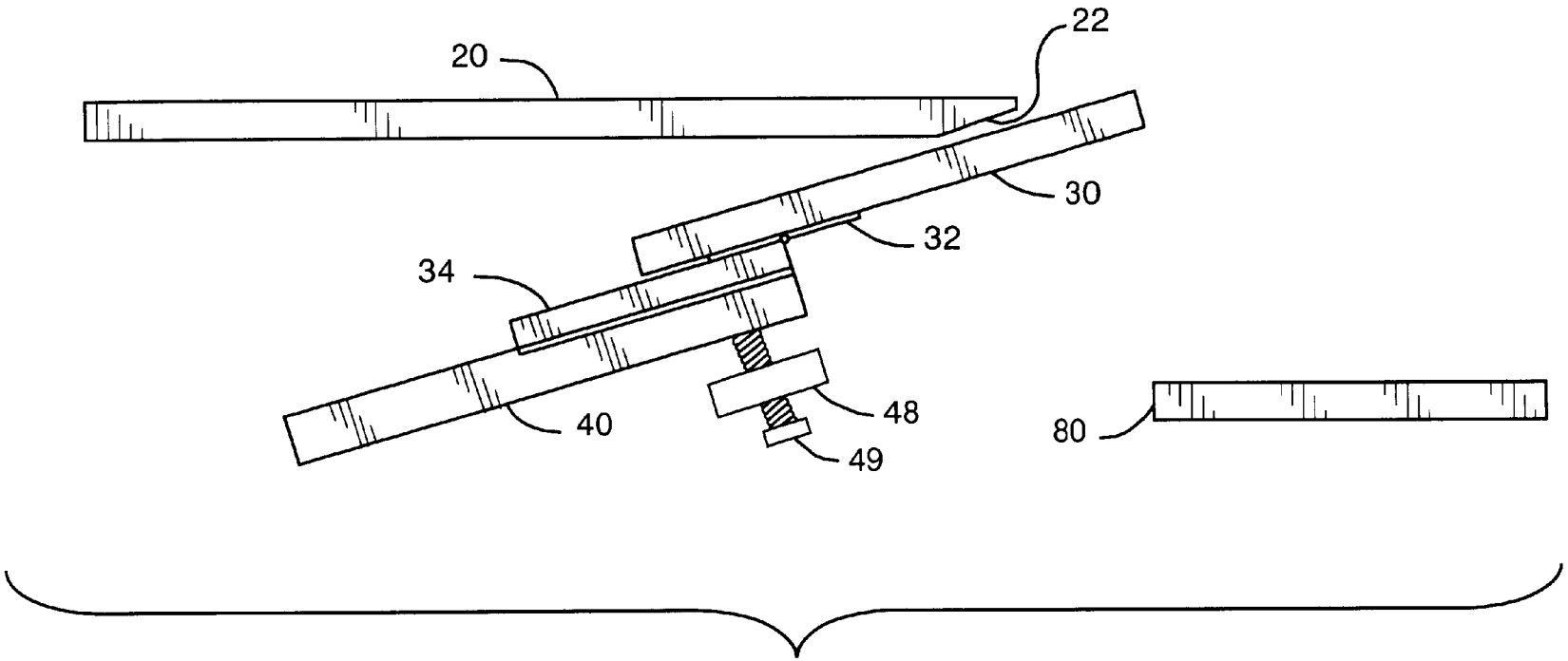
FIG. 10 is a partial cross section view of still yet another variation of the embodiment of FIGS. 3 and 4, illustrating a drawer slide attached to the side of the knee hole space so as to be rotatable about the lower attach point, with the front or upper end being adjustable over a limited range by use of a screw block and setscrew, with the sliding lid in the retracted position exposing a stationary keyboard shelf.

Referring to FIG. 10, drawer slide 40, and alternatively support board 46 in the case of the flat mount drawer slide of FIG. 7, is pivotally attached at the lower back comer to the desk structure so as to permit a small degree of rotational adjustment of the leading or upper end of drawer slide 40, or support board 46 in the case of FIG. 7. Left and right side threaded blocks 48 are secured to the desk structure. Adjustment screw 49, adjustable from the underside, supports the upper or leading edge of respective sliders 40, or left and right sides of support board 46 of FIG. 7. Adjustment of screws 49 raises or lowers the front end of slide 40 so that the exact alignment of lid 30 to desktop 20 can be obtained at the time of assembly, or readjusted later if necessary.

It is also within the scope of the invention to incorporate springs or gas cylinders or counterweights in any suitable manner that might expand the working envelope of weights, angles and dimensions of the illustrated embodiments and other obvious variations that operate fundamentally in accordance with the principles of the invention.

In an important extention or alternative embodiment, the stationary keyboard shelf may be replaced by a pull-out tray on slides. In this case the desk would offer three modes of use:

- Use of the keyboard from a sitting position close in to the desk and at a comfortable height below the desk top.
- Use of the lid as a writing surface or other purpose without having to move from the typing position.
- Use of the pullout keyboard tray so that the keyboard can be used while the lid is in place over the keyboard recess.

Figure 5:
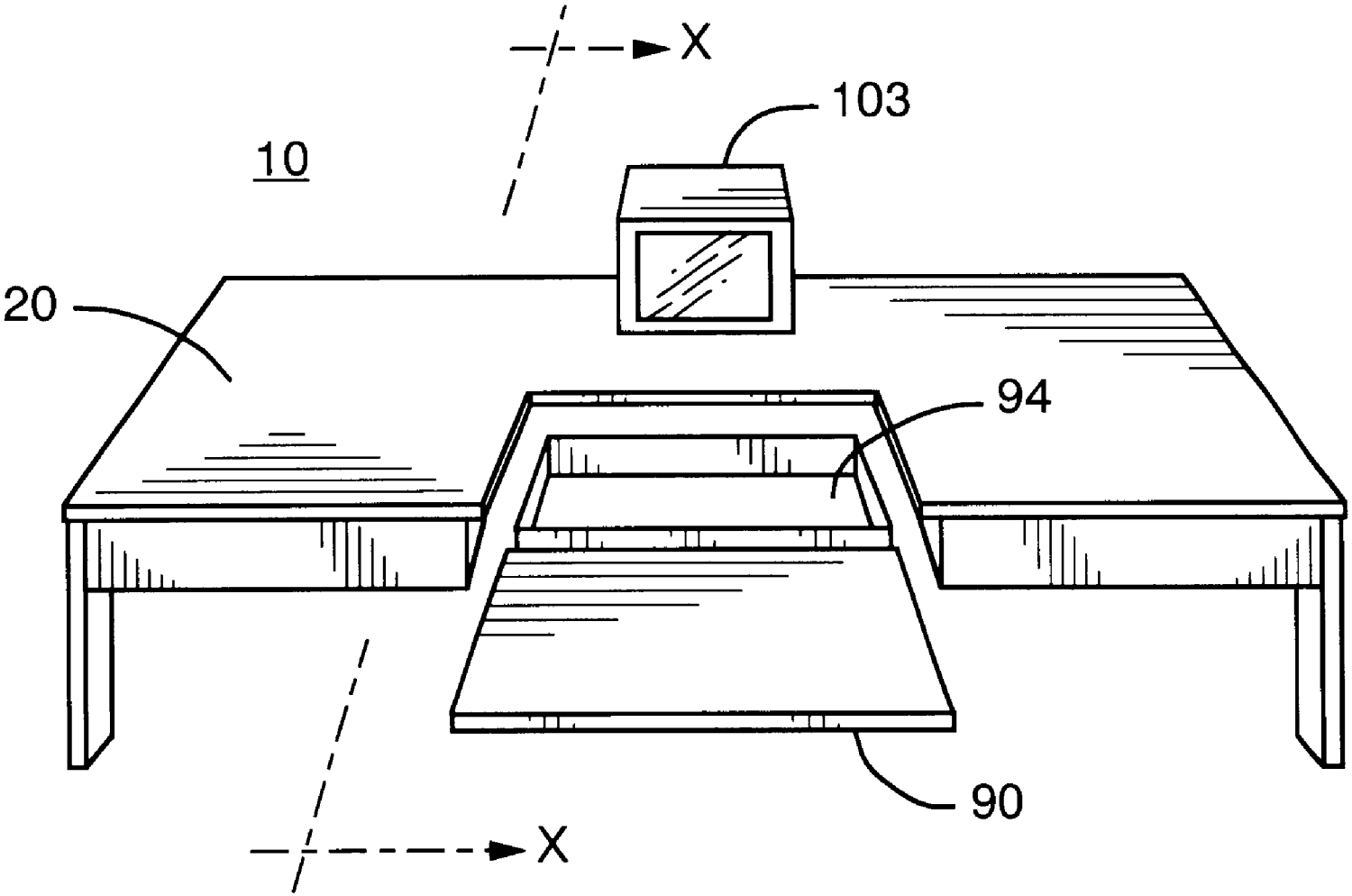
FIG. 5 is an upper front perspective view of a desk with a sliding lid feature and a sliding keyboard tray with accessory box, the keyboard tray in the extended position, the lid in the retracted position exposing the accessory box.
Figure 8:
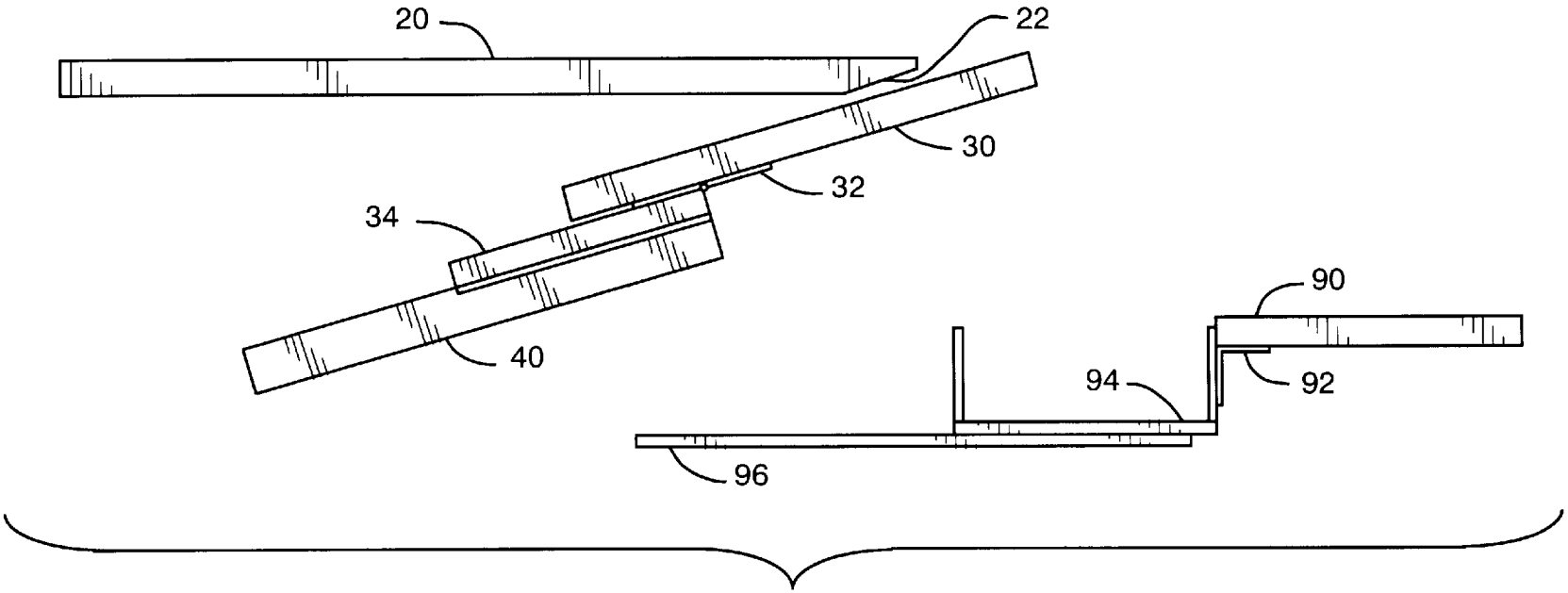
FIG. 8 is a partial cross section view of a variation of the embodiment of FIGS. 3 and 4, illustrating the orientation of the desktop, sliding lid in the retracted position exposing a sliding keyboard shelf and accessory box, the accessory box supported by side rails, the keyboard shelf in the extended position making the accessory box readily accessible.

FIG. 8 is a cross section through XX in FIG. 5. Referring to both FIGS. 5 and 8, there is shown in perspective in FIG.

5, desk 10 with lid 30 retracted. A retractable keyboard tray 90, the slides for which are omitted for clarity, is pulled forward to the extended position, giving access to drawer 94, which is attached by bracket 92 to the back side of tray 90, and supported on rails 96 so as to move with tray 90. Drawer 94 is pulled along with tray 90 into the extended position where drawer 94 is exposed for easy accessed via the lid opening in desktop 20, when lid 30 is in the retracted position.

Drawer 94 may be mounted on slides or on rails 96 as shown, or cantilevered off the back of tray 90, providing tray slides are adequate. Coupling between the tray and the drawer may be by means of a screwed bracket as shown or by other means including methods which permit easy de-coupling such as pegs protruding from the top edges of the drawer and fitting into holes in the tray.

It will be evident that the space under the desk revealed by the retracted lid 30 and pulled-forward tray 90 may be utilized for alternative purposes. This would comprise a fourth mode of use:

Use of the pull-out keyboard tray in conjunction with the retracted lid so as to provide access to the drawer or other device configured posterior of the keyboard tray, or to provide an opening through which a monitor or other information display device positioned below the desktop is visible to a user sitting at the keyboard.

Figure 9:
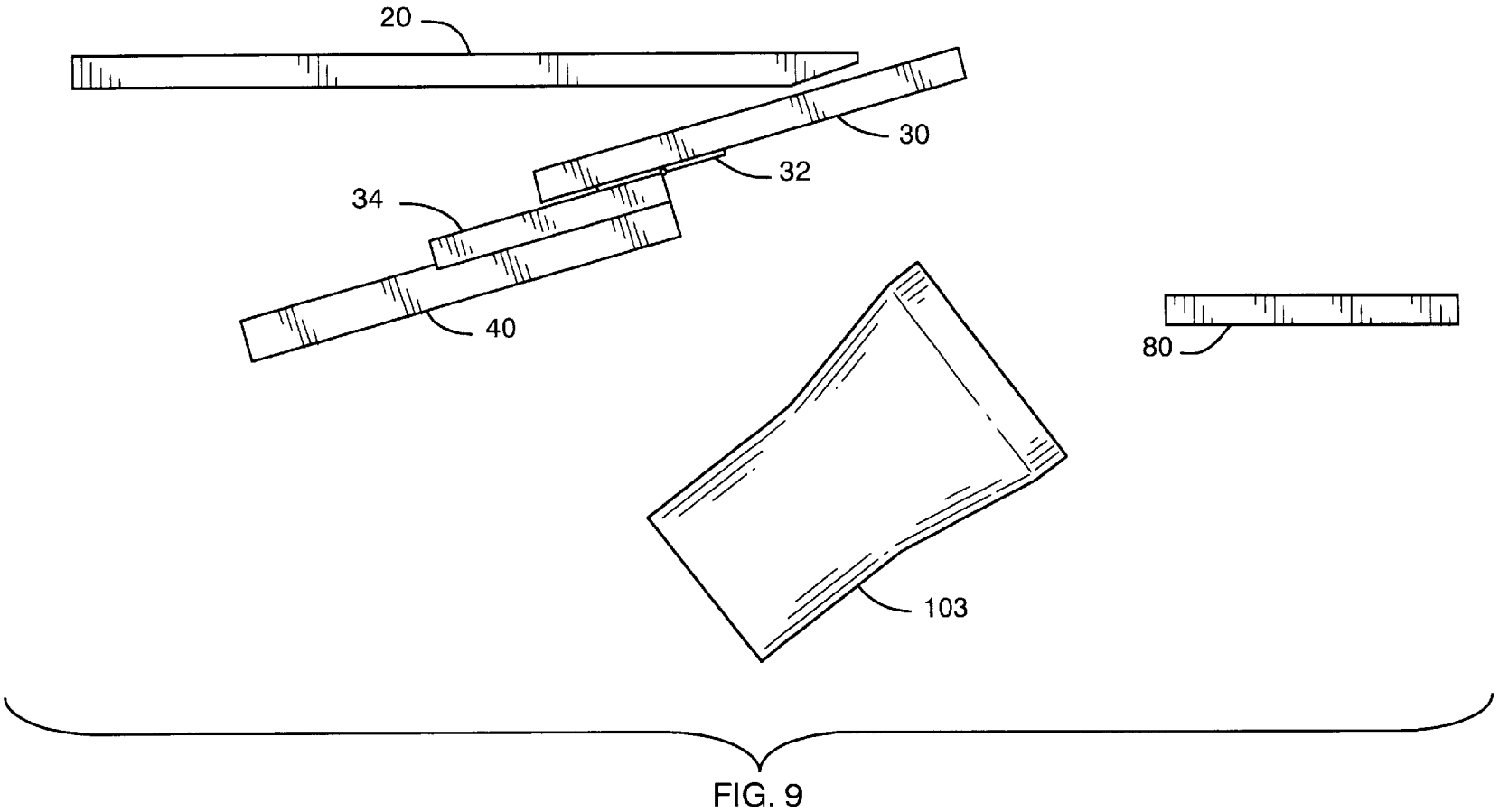
FIG. 9 is a partial cross section view of yet another variation of the embodiment of FIGS. 3 and 4, illustrating the orientation of the desktop, with the sliding lid in the retracted position exposing a stationary keyboard shelf and a computer monitor arranged at below-desktop level so as to be visible between the desktop and the keyboard shelf.

In yet a further important embodiment, FIG. 9 shows an alternate embodiment of a section through XX of FIG. 5, where the drawer of FIG. 8 is omitted, and a monitor 103 or other viewing device is supported by a shelf not shown for clarity, at an angle suitable for viewing by the user as described, when lid 30 is in the retracted position and the keyboard shelf 80 is mounted sufficiently forward or there is a slidable keyboard tray 90 in the extended position.

Other embodiments within the scope of the invention will be readily apparent to those skilled in the art, from the description, attached drawings, and the claims that follow.

I claim:

1. A desk convertible for use with a keyboard and electronic display unit comprising a desktop and support structure, a retractable desktop section, a desktop section opening in a front edge of said desktop, left and right side slider assemblies, each comprising a stationary component and a sliding component, respective said stationary components attached to said support structure underneath said desktop at a sloping angle, said sliding components slidable upward and forward to a raised position and downward and backward to a stowed position, a cross member connecting a front end of said sliding components, said desktop section hingedly attached to the front edge of said cross member, left and right side extended position desktop section supports attached to said desktop and support structure, said desktop section in said raised position supported by said desktop section supports and abutting a back edge of said desktop section opening, said desktop section being movable to said stowed position by tilting the front edge of said desktop section up and sliding said desktop section down and back on said slider assemblies.

2. A desk convertible for use with a keyboard and electronic display unit according to claim 1, further comprising a support board to which each said stationary component is attached, said support board being attached at a sloping angle to said support structure beneath said desktop.

3. A desk convertible for use with a keyboard and electronic display unit according to claim 1, the lower end of said stationary components being pivotally attached to said support structure, the upper end of said stationary components bearing on adjustable supports attached to said support structure, said adjustable supports having means for adjusting said sloping angle of said stationary components.

4. A desk convertible for use with a keyboard and electronic display unit according to claim 1, further comprising a stationary keyboard shelf below the level of said desktop section when in said raised position, said keyboard shelf being accessible for use when said desktop section is in said stowed position.

5. A desk convertible for use with a keyboard and electronic display unit according to claim 1, further comprising a slidable keyboard tray located below the level of said desktop and being movable between a retracted position beneath said desktop section when in said raised position and an extended position outboard of said desktop.

6. A desk convertible for use with a keyboard and electronic display unit according to claim 5, further comprising means for supporting a said display unit below said desktop at a viewing angle visible between said desktop section in said stowed position and said keyboard tray in said extended position.

7. A desk convertible for use with a keyboard and electronic display unit according to claim 5, further comprising an accessory box attached to the backside of said slidable keyboard tray.

8. A desk convertible for use with a keyboard comprising a desktop, a retractable desktop section, a desktop section opening in a front edge of said desktop, left and right side slider assemblies, each comprising a stationary component and a sliding component, respective said stationary components attached to the underside of said desktop at a sloping angle, said sliding components slidable upward and forward to a raised position and downward and backward to a stowed position, said desktop section hingedly attached to a front ends of said sliding components, left and right side extended position desktop section supports attached to said desktop, said desktop section in said raised position supported by said desktop section supports and abutting a back edge of said desktop section opening, said desktop section being movable to said stowed position by tilting the front edge of said desktop section up and sliding said desktop section down and back on said slider assemblies.

9. A desk convertible for use with a keyboard and electronic display unit according to claim 1, further comprising a stationary keyboard shelf below the level of said desktop section when in said raised position, said keyboard shelf being accessible for use when said desktop section is in said stowed position.

10. A desk convertible for use with a keyboard and electronic display unit according to claim 1, further comprising a slidable keyboard tray located below the level of said desktop and being movable between a retracted position beneath said desktop section when in said raised position and an extended position outboard of said desktop.

11. A kit for a desk convertible for use with a keyboard and electronic display unit comprising a desktop and support structure, a retractable desktop section, a desktop section opening in a front edge of said desktop, left and right side slider assemblies, each comprising a stationary component and a sliding component, respective said stationary components being attachable to said support structure underneath said desktop at a sloping angle, said sliding components slidable upward and forward to a raised position and downward and backward to a stowed position, a cross member connectible to the respective front ends of said sliding components, said desktop section hingedly attachable to a front edge of said cross member, left and right side extended position desktop section supports attachable to said desktop and support structure, said desktop section movable into said raised position so as to be supported by said desktop section supports and abutting a back edge of said desktop section opening, said desktop section being movable to said stowed position by tilting the front edge of said desktop section up and sliding said desktop section down and back on said slider assemblies.

12. A kit for a desk convertible for use with a keyboard and electronic display unit according to claim 11, further comprising a support board to which each said stationary component is attached, said support board being attachable at a sloping angle to said support structure beneath said desktop.

13. A kit for a desk convertible for use with a keyboard and electronic display unit according to claim 11, the lower end of said stationary components being pivotally attachable to said support structure with the upper end of said stationary components bearing on adjustable supports, said adjustable supports attachable to said support structure, said adjustable supports having means for adjusting said sloping angle of said stationary components.

14. A kit for a desk convertible for use with a keyboard and electronic display unit according to claim 11, further comprising a stationary keyboard shelf attachable to said support structure below the level of said desktop section when in said raised position, said keyboard shelf being then accessible for use when said desktop section is in said stowed position.

15. A kit for a desk convertible for use with a keyboard and electronic display unit according to claim 11, further comprising a slidable keyboard tray mountable below the level of said desktop and being then movable between a retracted position beneath said desktop section when in said raised position and an extended position outboard of said desktop.

16. A kit for a desk convertible for use with a keyboard and electronic display unit according to claim 15, further comprising means for supporting a said display unit below said desktop at a viewing angle visible between said desktop section in said stowed position and said keyboard tray in said extended position.

17. A kit for a desk convertible for use with a keyboard and electronic display unit according to claim 15, further comprising an accessory box attachable to the backside of said slidable keyboard tray.

18. A desk convertible for use with a keyboard and electronic display unit according to claim 1, said desk being made of wood.

19. A mechanism for operating a retractable desktop section in and out of a desktop section opening in the front edge of the desktop of a desk convertible for use with a keyboard and electronic display unit comprising left and right side slider assemblies, each comprising a stationary component and a sliding component, respective said stationary components being attachable to said desk beneath said desktop at a sloping angle at respective left and right sides of said opening, said sliding components slidable upward and forward to a raised position and downward and backward to a stowed position, a cross member connecting the respective front ends of said sliding components, a hinge means on said cross member, said hinge means connectible to said desktop section so as to permit tilting the front edge thereof upward to about parallel with said slider assemblies, and means for supporting said desktop section in said raised position, said desktop section being movable to a stowed position beneath said desktop by tilting said front edge of said desktop section up and sliding said desktop section down and back on said slider assemblies.

20. A mechanism for operating a retractable desktop section according to claim 19, said slider assemblies attached to a common support structure, said support structure attachable to said desk beneath said desktop.

* * * * *